United States Patent [19]

Bailey et al.

[11] 4,073,022

[45] Feb. 14, 1978

[54] MANUFACTURE OF SHOES

[75] Inventors: Frank Gordon Bailey, Kettering; George Trevor Ralphs, Bath, both of England

[73] Assignee: C. & J. Clark Ltd., England

[21] Appl. No.: 699,808

[22] Filed: June 25, 1976

[30] Foreign Application Priority Data

June 25, 1975 United Kingdom ..... 27010/75

[51] Int. Cl.[2] ..... A43D 3/00

[52] U.S. Cl. ..... 12/135 A

[58] Field of Search ..... 12/135 R, 127, 126; 36/135 A

[56] References Cited

U.S. PATENT DOCUMENTS

| | | | |
|---|---|---|---|
| 3,314,091 | 4/1967 | Levaggi | 12/135 R |
| 3,317,940 | 5/1967 | Ludwig | 12/135 R |

FOREIGN PATENT DOCUMENTS

| | | | |
|---|---|---|---|
| 2,110,666 | 9/1971 | Germany | 12/135 A |

*Primary Examiner*—Patrick D. Lawson

*Attorney, Agent, or Firm*—Wenderoth, Lind & Ponack

[57] ABSTRACT

A last for use in the manufacture of shoes has a main body portion and a separate heel part which is slidably mounted on the body portion and can be completely removed therefrom within a shoe to facilitate the removal of this shoe from the body portion of the last. Likewise the positioning of an upper or shoe on the last may be effected by inserting the separated heel part in the upper or shoe, arranging this about the body portion and sliding the heel part onto the body portion. The heel part and body portion may be formed one with a rib and the other with a groove, the rib and groove being formed with inter engaging portions. A latch is provided for locking the heel part in its operative position on the body portion and a post on which the last may be mounted may include means for releasing the latch to enable the heel part to be slid off the body portion.

9 Claims, 2 Drawing Figures

MANUFACTURE OF SHOES

This invention relates to the manufacture of shoes, the word shoe being used herein in the broad sense to include, where the context so permits, all forms of outer footwear, and more particularly to an improved form of last which facilitates both the assembly of an upper on the last and the de-lasting of a shoe.

The improved last of this invention comprises a main body portion and a separate heel part which is slidably mounted on the body portion and completely detachable therefrom.

In order to effect the slidable mounting of the heel part on the body portion one may be formed with a groove and the other with a rib, the groove and rib having interengaging portions. Conveniently the heel part slides on the body portion on a path which may be straight but is preferably arcuate.

A latch may be provided to secure the heel part on the body portion in its operative position and this may take the form of a spring member on the heel part which engages an abutment on the body portion. Manual or machine operated means may be provided for releasing the latch when it is desired to detach the heel part.

The improved last may be made in such a way that it may be transferred from the last post of one machine to the post of a different machine. In this case the means for mounting the last on a post are such that the last is positively located in a position determined by the position and orientation of the post on its machine. Such means may comprise a socket of non-circular section formed in the main body portion of the last which receives a post of similar section. Conveniently the section of the socket and the post is rectangular although other non-circular sections may be used. Alternatively the last may be provided with a spigot of non-circular section which is received in a socket of similar section formed in the post. The or one of the posts may include the means for releasing the latch which locks the heel part on the body portion of the last and these means may include a plunger mounted in the post which engages the spring member to move it out of the locking position.

The last may be of the kind which includes a fore part filler portion which is movable forwardly and rearwardly relative to the main body portion of the last and a sole plate secured thereto. In such case the post on one of the machines on which the improved last may be mounted may include a movable part which co-operates with the fore part filler portion of the last to move this portion forwardly. For this purpose the fore part filler portion may be formed to provide a part which, when the last is mounted on its post, is positioned so as to be drivingly engaged by the movable part of the post whereby to effect the desired movement of the fore part filler portion.

In subsequent operations the last may be moved to at least one further machine in which the last will be mounted on a post that again provides positive location and the required orientation to the last. The post on such further machine need not however be provided with a movable part for moving the fore part filler portion to its forward position.

The last may include means for holding the fore part filler portion in its forward position when the last is removed from a post and these means may be arranged so as to be releasable by the operator at any time, or by a machine, at an appropriate point in the cycle of a operations, when the last is mounted on a post in that machine.

One form of the improved last of this invention will now be described with reference to the accompanying drawing in which.

Figure 1:
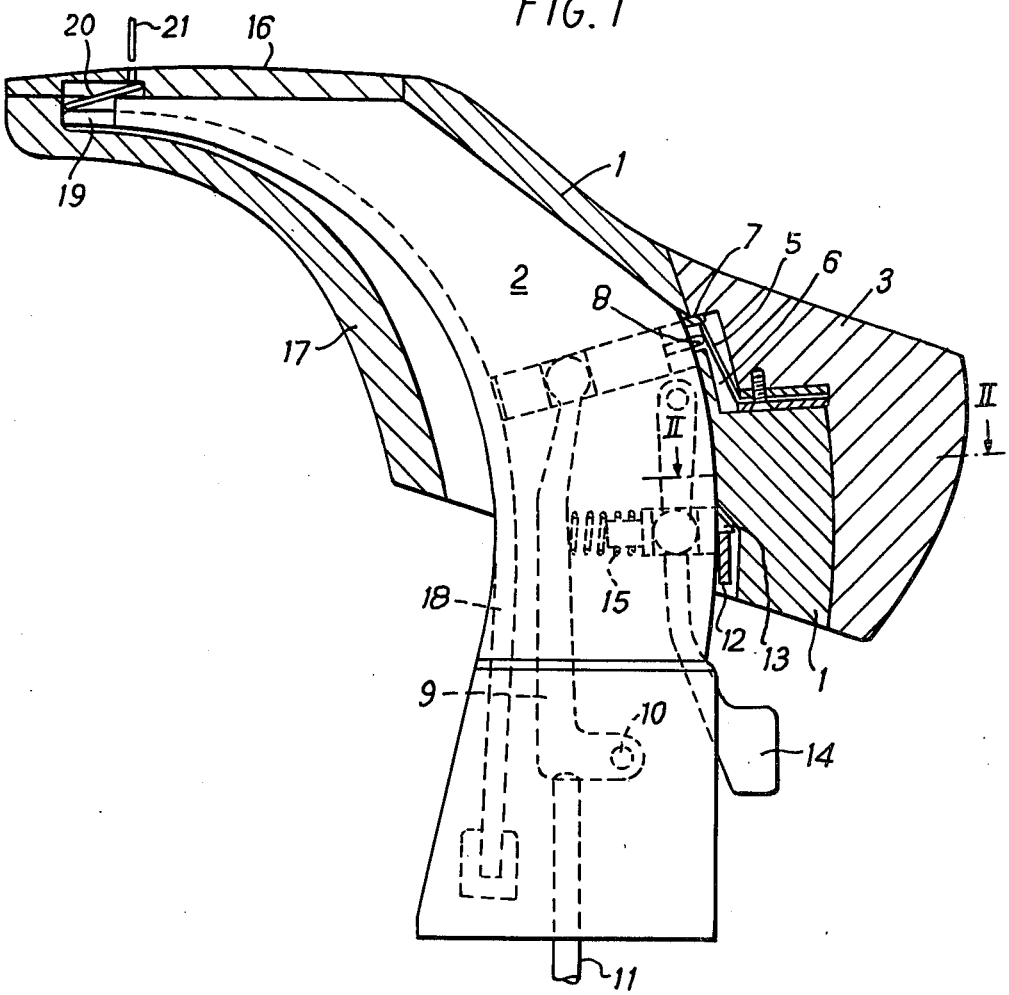
FIG. 1 is a vertical section taken through a last mounted on a post.
Figure 2:
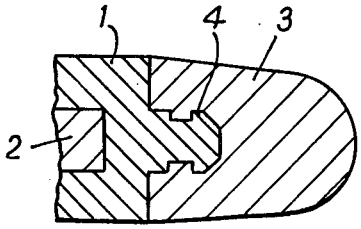
FIG. 2 is a section taken on the line II—II in FIG. 1.

As shown the last comprises a main body portion 1 which is moulded from a suitable plastic material around a metal frame (not shown) which defines a socket of rectangular section in which a post 2 is received. A heel part 3 is mounted on the body portion 1 in such a manner that it can be completely detached therefrom by a sliding movement which, in the drawing, is upwards and forwards. For this purpose the heel part 3, as shown more clearly in FIG. 2, is formed with a groove which mates and interlocks with a rib 4 on the body portion. Although the heel part 3 may slide on the body portion 1 along a path which is straight in the preferred illustrated arrangement this path is arcuate. In the illustrated last the heel part 3 is shown in its normal operative position and is located in that position against downwards movement by abutting surfaces formed on the heel part and body portion respectively.

In order that the heel part 3 may be locked in its operative position it is provided with a spring member 5 which as the heel part is slid towards the operative position enters a groove 6 in the body portion 1. When the heel part reaches its operative position the free end of the spring member moves so as to abut a reinforcing piece 7 in the body portion whereby to lock the heel part in position. The post 2 on which the last is mounted has a plunger 8 slidably mounted therein which can be moved through an aperture in the body portion to engage and move the end of the spring member 5 away from the piece 7 thereby to free the heel part 3 for upward movement when it is required to remove the heel part from the last in order to de-last a shoe. As shown the plunger 8 is moved by a lever 9, pivoted at 10, which is operated on by a push rod 11 actuated by the machine on which the post is mounted. Alternatively or in addition the post may carry manually operable means for moving the plunger 8.

The illustrated last is of the kind which may be transferred from a post on one machine to a suitably positioned post on another machine and either or both posts may include the described means for unlocking the heel part 3. In order to locate the last on a post the body portion 1 of the last is provided with means which locates on a stop provided on the post 2 and also with a plate 12 which can be engaged by a movable latch 13 mounted in the post 2 to lock the last in position on the post. The last may be unlocked by manual operation of a lever 14 which acts to retract the latch 13 against the action of a spring 15.

The illustrated last is also of the kind which may be expanded during a lasting operation. The last has a sole plate 16 which is detachably mounted on the body portion 1 and a separate fore part filler portion 17 which is slidable relative to the sole plate and body portion between the forward position shown and a rearward position.

The post of one machine on which the improved last of this invention may be mounted includes a pusher member 18 conveniently mounted in a groove formed in the forward face of the post. This member has a forward end 19 which when the member is actuated by the machine on which the post is mounted moves to the left in the drawing to engage the toe end of the fore part filler portion 17 to move this portion to its forward position shown in the drawing.

When the fore part filler portion 17 reaches its forward position the forward end of a latch plate 20 pivotally carried on the sole plate 16 drops down to engage the toe end and thus locks the fore part filler portion 17 in its forward position. While the fore part filler portion is thus locked in position the last may be transferred from the post of one machine to the post of another machine. Unlocking of the fore part filler portion may be effected at any desired time by inserting a pin 21 through an aperture in the sole plate 16 so as to tilt the latch plate 20 to a horizontal position.

In using the illustrated last it may first be mounted, with the heel part 3 removed, on the post of a lasting machine and locked thereon by latch 13. An upper with the heel part suitably positioned therein is then applied round the last and the heel part is slid on the body portion 1 to the position in which it is locked in place by the spring member 5. During the lasting operation the fore part filler portion is moved to its forward position by the pusher member 18 and locked in this position by latch plate 20.

After lasting is completed the latch 13 is retracted and the last transferred to the post of a second machine in which a sole-laying operation may be carried out. During the transfer the fore part filler portion will remain locked in its forward portion and will be so held by the tension in the lasted upper.

The post of the second machine need not have the pusher member 18 but may have the latch 13 and the plunger 8 which acts on the spring member 5 to unlock the heel part 3. After sole laying is complete the heel part 3 is unlocked and slid off the body portion 1 inside the finished shoe which may thus be easily and quickly delasted. Thereafter the last is removed and the fore part filler portion 17 is unlocked, by tilting the latch plate 20, and slid to its retracted position.

The improved last of this invention greatly simplifies and speeds up the application of an upper or lasted upper onto the last or the removal therefrom of a lasted upper or a finished shoe since the heel part, being completely detachable may be inserted in the upper or lasted upper before application to the last and may be removed within a lasted upper or finished shoe during the delasting thereof.

We claim:

1. For use in the manufacture of shoes, the combination of a last and a last post, the last comprising a main body portion and the post having an upper end portion, one of said portions having a socket therein of a noncircular cross-section and the other portion having a spigot having a cross-sectional shape complementary to said socket and mating with the socket for locating and detachably mounting said last on said post, said last further comprising a heel part slidably mountable on said body portion for sliding a distance for removing said heel part from said body portion, a rib and a mating groove formed one on the body portion and the other on the heel part, said rib and groove when interengaged mounting said heel part on said body portion in slidable engagement therewith, said body portion and said heel part respectively having surfaces thereon which abut when said heel part is slid to an operative position, a spring latch secured on said heel part and having a free end movable to engage an abutment on said body portion when said heel part is slid to its operative position, and means for moving said free end out of engagement with said abutment for releasing said heel part for removal from said body portion.

2. A last as claimed in claim 1 wherein the heel part slides on the body portion on an arcuate path.

3. A last as claimed in claim 1 wherein the body portion includes a sole plate and a fore part filler portion which is slidable relative to the body portion and sole plate.

4. For use in the manufacture of shoes the combination of a last and a last post wherein said last comprises a main body portion having a socket of non-circular section formed therein, and a separate heel part which is slidably and detachably mounted on the body portion; and said last post comprises an end portion of non-circular section which mates with said socket for locating and detachably mounting said last, and a releasable latch for securing said last in operative position thereon.

5. A last as claimed in claim 4 including manual or machine operated means for moving the latch to enable the heel part to be slid off the body portion.

6. The combination of claim 4 wherein the post includes manually operable means for releasing the latch.

7. For use in the manufacture of shoes the combination of a last and a last post wherein said last comprises a main body portion having a socket of non-circular section therein, a heel part slidably and detachably mounted on the body portion, and a latch for locking the heel part in operative position on the body portion; and said last post comprises an end portion of non-circular section which mates with said socket for locating and detachably mounting said last, and means for engaging and moving said latch to release the heel part of said last.

8. A last as claimed in claim 7 wherein the latch comprises a spring member mounted on the heel part which in the operative position engages an abutment on the body portion.

9. The combination of claim 7 wherein the means for moving the latch comprises a plunger slidably mounted within the post.

* * * * *